US005834046A

United States Patent [19]

Turpin et al.

[11] Patent Number: 5,834,046

[45] Date of Patent: Nov. 10, 1998

[54] CONSTRUCTION INCLUDING INTERNAL CLOSURE FOR USE IN MICROWAVE COOKING

[75] Inventors: Charles H. Turpin, Minneapolis; Lance B. Schilmoeller, Bloomington; James W. Montealagre, North Oaks, all of Minn.

[73] Assignee: Golden Valley Microwave Foods, Inc., Edina, Minn.

[21] Appl. No.: 789,118

[22] Filed: Jan. 27, 1997

Related U.S. Application Data

[63] Continuation of Ser. No. 441,191, May 15, 1995, abandoned.

[51] Int. Cl.[6] ..... B65D 85/00

[52] U.S. Cl. ..... 426/107; 426/111; 426/112; 426/113; 426/124; 426/234; 426/412; 219/10.55 E

[58] Field of Search ..... 426/107, 111, 426/234, 112, 113, 124, 412; 219/10.55 E

[56] References Cited

U.S. PATENT DOCUMENTS

| | | | |
|---|---|---|---|
| D. 206,358 | 11/1966 | Griese | D58/17 |
| D. 221,625 | 8/1971 | Kinney et al. | D9/99 |
| D. 280,075 | 8/1985 | Haag, Sr. | D9/370 |
| 2,673,805 | 3/1954 | Colman | 426/111 |
| 2,673,806 | 3/1954 | Colman | 426/111 |
| 2,815,883 | 12/1957 | Robins et al. | 421/111 |
| 2,819,976 | 1/1958 | Hines | 426/111 |
| 2,858,768 | 11/1958 | Barnes et al. | 426/111 |
| 2,865,768 | 12/1958 | Barnes et al. | 426/111 |
| 3,052,554 | 9/1962 | Colman | 426/111 |
| 3,140,034 | 7/1964 | Wyman et al. | 426/111 |
| 3,519,439 | 7/1970 | Dunn | 426/111 |
| 3,671,270 | 6/1972 | Jehn | 99/171 |
| 3,782,976 | 1/1974 | Maier et al. | 426/110 |
| 3,969,535 | 7/1976 | Bourns | 426/111 |
| 4,038,425 | 7/1977 | Brandberg et al. | 426/107 |
| 4,190,757 | 2/1980 | Turpin et al. | 219/10.55 E |
| 4,219,573 | 8/1980 | Borek | 426/107 |
| 4,230,924 | 10/1980 | Brastad et al. | 219/10.55 E |
| 4,233,325 | 11/1980 | Slangan et al. | 426/107 |
| 4,248,901 | 2/1981 | Austin | 426/119 |
| 4,260,101 | 4/1981 | Webinger | 229/41 C |
| 4,267,420 | 5/1981 | Brastad | 219/10.55 E |
| 4,279,993 | 7/1981 | Austin et al. | 426/124 |
| 4,292,332 | 9/1981 | McHam | 426/111 |
| 4,355,757 | 10/1982 | Roccaforte | 227/19 |
| 4,398,077 | 8/1983 | Freedman et al. | 219/10.55 E |
| 4,399,159 | 8/1983 | Guibert | 426/113 |
| 4,448,309 | 5/1984 | Roccaforte et al. | 206/525 |
| 4,453,665 | 6/1984 | Roccaforte et al. | 221/41 B |
| 4,477,705 | 10/1984 | Danley et al. | 219/10.55 E |
| 4,518,651 | 5/1985 | Wolfe, Jr. | 428/308.8 |
| 4,553,010 | 11/1985 | Bohrer et al. | 219/10.55 E |
| 4,571,337 | 2/1986 | Cage et al. | 426/107 |
| 4,584,202 | 4/1986 | Roccaforte | 426/111 |
| 4,586,649 | 5/1986 | Webinger | 229/114 |

(List continued on next page.)

FOREIGN PATENT DOCUMENTS

| | | |
|---|---|---|
| 0251 445 A2 | 1/1988 | European Pat. Off. . |
| 0336 325 A2 | 10/1989 | European Pat. Off. . |
| WO 91/15096 | 10/1991 | European Pat. Off. . |

OTHER PUBLICATIONS

The Wiley Encyclopedia of Packaging Technology "1986" p. 285–288, 317–320, 455, 457, 458.

*Primary Examiner*—Lien Tran
*Attorney, Agent, or Firm*—Merchant, Gould, Smith, Edell, Welter & Schmidt, P.A.

[57] ABSTRACT

A construction for heating food in a microwave oven is provided. The construction includes an outer receptacle and a moisture barrier closure enclosed within the outer receptacle. Food material to be heated is enclosed within the moisture barrier closure, during storage. Preferred arrangements include an outer receptacle which is expandable to accommodate expansion of the food material, preferably popcorn, upon heating. In a preferred construction shown, a microwave susceptor construction is positioned within the moisture barrier closure.

7 Claims, 5 Drawing Sheets

U.S. PATENT DOCUMENTS

| | | | |
|---|---|---|---|
| 4,612,431 | 9/1986 | Brown et al. | 219/10.55 E |
| 4,641,005 | 2/1987 | Seiferth | 219/10.55 E |
| 4,661,671 | 4/1987 | Maroszek | 219/10.55 E |
| 4,663,506 | 5/1987 | Bowen et al. | 219/10.55 E |
| 4,678,882 | 7/1987 | Bohrer et al. | 383/116 |
| 4,698,472 | 10/1987 | Cox et al. | 219/10.55 E |
| 4,701,585 | 10/1987 | Stewart | 219/10.55 E |
| 4,734,288 | 3/1988 | Engstrom et al. | 426/107 |
| 4,735,513 | 4/1988 | Watkins et al. | 383/116 |
| 4,738,882 | 4/1988 | Rayford et al. | 428/35 |
| 4,810,844 | 3/1989 | Anderson | 219/10.55 E |
| 4,861,958 | 8/1989 | Bohrer et al. | 219/10.55 E |
| 4,864,090 | 9/1989 | Maxwell et al. | 219/10.55 E |
| 4,878,765 | 11/1989 | Watkins et al. | 383/116 |
| 4,959,231 | 9/1990 | Lakey et al. | 426/111 |
| 5,008,024 | 4/1991 | Watkins | 219/10.55 E |
| 5,044,777 | 9/1991 | Watkins et al. | 383/100 |
| 5,045,659 | 9/1991 | Wolfe et al. | 219/10.55 |
| 5,081,330 | 1/1992 | Brandberg et al. | 219/10.55 E |
| 5,097,107 | 3/1992 | Watkins et al. | 219/10.55 E |
| 5,153,402 | 10/1992 | Quick et al. | 219/10.55 E |
| 5,178,294 | 1/1993 | Hill et al. | 220/469 |
| 5,190,777 | 3/1993 | Anderson et al. | 426/107 |
| 5,200,590 | 4/1993 | Bowen et al. | 219/10.55 E |
| 5,214,257 | 5/1993 | Riskey | 219/10.55 E |

CONSTRUCTION INCLUDING INTERNAL CLOSURE FOR USE IN MICROWAVE COOKING

This is a Continuation of application Ser. No. 08/441,191, filed May 15, 1995 now abandoned.

FIELD OF THE INVENTION

The present invention relates to moisture barrier packaging for food. A preferred application relates to a package which is suitable to be placed in a microwave oven for use in preparing microwave popping popcorn or similar materials which expand when cooked. The invention also concerns a particularly preferred method for preparing the arrangement and methods of use.

BACKGROUND OF THE INVENTION

A variety of packages for the microwave popping of popcorn are known. Some of these are used only for popping popcorn; others are used not only to provide for popping of the popcorn but also to provide a convenient, rigid-walled, serving container. Some examples of these latter are provided in the following U.S. patents: Watkins U.S. Pat. No. 5,008,024; and Watkins U.S. Pat. No. 5,097,107. The disclosures of '024 and '107 are incorporated herein by reference.

In general, the technical problems involved in packages intended for both microwave popping and to serve as a rigid-walled container for serving the popcorn are different from those for flexible packaging which is designed principally to accommodate popping; the latter being arrangements such as flexible bag constructions of the type described in U.S. Pat. No. 5,044,777, incorporated herein by reference.

In general, preferred large scale commercial activity with microwave popcorn involves a product distribution at ambient temperature and a shelf life of at least nine months. Prior rigid-walled packages intended for both microwave popping and for serving popcorn have not been completely satisfactory with respect to shelf life, under ambient temperature distribution and storage, and improvement has been desired.

In general, what has been sought has been a package arrangement suitable for both microwave popping and serving of popcorn. Preferably the arrangement is one which: is relatively inexpensive to manufacture; is relatively convenient and easy to store and ship; provides for good popcorn volume; and, provides for improved and desired shelf life.

SUMMARY OF THE INVENTION

According to the present invention, a construction is provided for heating food in a microwave oven. The construction is one which is placed in a microwave oven, in use. The construction generally comprises an outer receptacle and a moisture barrier closure positioned within the outer receptacle. In the typical application, the arrangement includes food material to be heated enclosed within the moisture barrier closure.

Preferably the outer receptacle is expandable, during use. Expansion can be provided, for example, through use of an invertible balloon film over an opening in the outer receptacle.

Preferably the moisture barrier closure comprises a first portion and a second portion, sealed to one another with a perimeter seal. The first portion preferably comprises a first sheet of moisture barrier polyolefin film secured to a polyester film; and, the second portion preferably comprises a moisture barrier polyolefin film secured to a polyester film. In certain preferred embodiments, one of the two portions comprises a bottom portion, and preferably is a thermoformed dish.

In preferred embodiments, the moisture barrier closure includes therein a microwave interactive susceptor. Preferably the microwave interactive susceptor is formed as a dish, to enclose a charge of food material to be heated.

Preferred applications involve arrangements wherein the food charge includes unpopped popcorn kernels. In some applications, appropriate amounts of oil or fat, to facilitate cooking, and, if desired, flavoring, may be used. When oil is used, in a typical arrangement it is foreseen that the weight ratio of popcorn to oil will be within the range of about 60:40 to 90:10. The amount of flavoring will generally be an amount appropriate to achieve delivery of a desired flavoring to the food. It is foreseen that in some applications, oil will not be used.

THE FIGURES

DETAILED DESCRIPTION OF THE INVENTION

Figure 1:
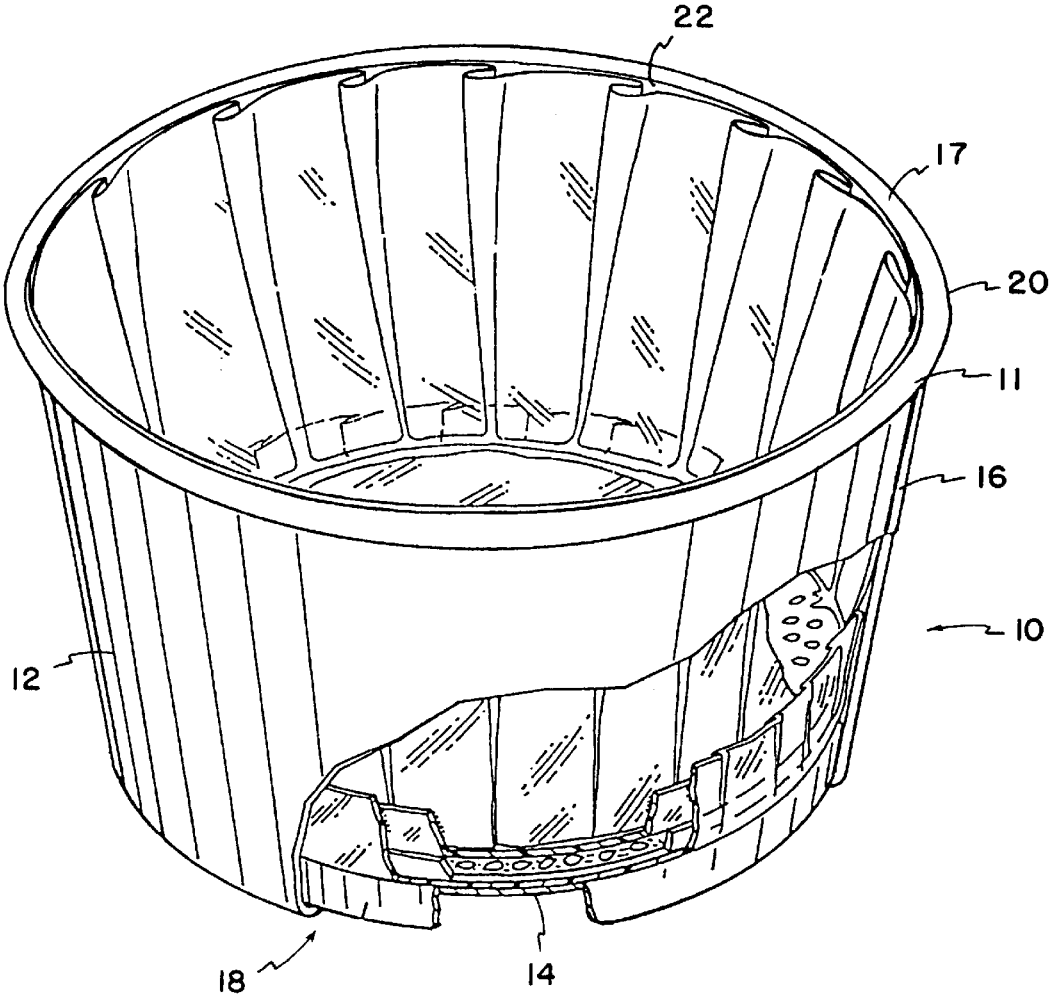
FIG. 1 is a perspective view of the package construction according to the preferred embodiment of the present invention, with portions broken away to show internal detail.

The techniques presented herein are described with respect to application in expandable packaging for use in preparing microwave popcorn, a product which expands when it is cooked. Some of the techniques, however, are advantageously adaptable to other types of products, including ones that do not expand when heated.

Shelf-Life and Moisture Loss

An important factor in determining the shelf life of popcorn is loss of moisture from the unpopped popcorn kernels. Popcorn moisture content should be controlled within a narrow range in order to achieve good popping. Maintaining this optimum moisture range is especially important when microwave popping is intended.

The optimum moisture content range varies with the popcorn. Generally it is around 13 to 14% by weight. This optimum moisture content corresponds to an ERH (Equilibrium Relative Humidity) of about 75%. Average or typical RH (Relative Humidity) in ambient storage conditions is around 50% and can be much lower in wintertime heated warehouses, stores or homes. Unless a suitable moisture barrier is provided around the popcorn, in time moisture will be lost in storage, with a concomitant loss of popping quality.

Even a small loss in moisture content can be unacceptable. Indeed, in some instances, a reduction of moisture content as small as a change from 13% to 11% can result in noticeable loss in popping characteristics.

Many microwave popcorn constructions comprise flexible paper bags which expand when popcorn contained in them is popped. Such flexible bags can be folded to a relatively small size, typically about 10 cm×14 cm×2 cm, when stored with unpopped popcorn in them. Moisture loss during storage for such arrangements is typically controlled by enclosing the folded bag in a moisture barrier film, typically 118 to 140 gauge oriented polypropylene having a MVTR (Moisture Vapor Transmission Rate; according to ASTM E98-66, incorporated herein by reference) of typically 0.20 to 0.30 gm/100 sq.in. per 24 hours at 100° F. and 90% relative humidity. In use, the moisture barrier film is removed and discarded before the arrangement is unfolded and exposed to microwave energy for cooking the popcorn. Thus, the moisture barrier film need not be a material that can withstand the conditions of cooking or exposure to microwave energy in an oven.

Now consider arrangements such as those described in U.S. Pat. Nos. 5,097,107 and 5,008,024. The arrangements described in these patents, when commercially applied, are relatively large tubs or containers which, although they have expandable covers, have rigid sidewalls and are intended to be used to form a dish or container for serving the popcorn after it is popped. Thus, such constructions, in commercial use, are relatively large and rigid and cannot be folded to a small size for sealing within a small sheet or envelope of moisture barrier film.

One can, of course, conceive of using a relatively large moisture barrier film for enclosing these types of arrangements, to protect against moisture loss. Such an approach, however, is generally impractical. A reason for this is that the quantity of moisture that permeates out of a package is a function of both the permeability of the moisture barrier and the surface area of the package. Wrapping a large package requires a large area of barrier film. Indeed, typical 0.5 gallon tub arrangements, such as those that might be used for a commercial half gallon popcorn "tub" product, would need at last 3 to 4 times as much area of barrier film as a typical wrapped 10 cm×14 cm×2 cm folded bag arrangement. To achieve a desired level of moisture protection for such tubs (to provide substantially the same level of moisture protection afforded the folded bags) would require an overwrap or a film with a MVTR on the order of 0.10 gm/100 sq. in. or less. This would require either a very thick film with high WVTR barrier properties or one including metal, neither of which is desirable or practical for applications involving microwave popcorn packaging.

A Preferred Construction

In FIGS. 1–5, a preferred construction 10 for microwave popping and serving popcorn is depicted. The construction 10 comprises a package 11 that includes a container or tub shaped body 12 with: a bottom wall 14; and an upright rigid side wall construction 16. The side wall construction 16 is secured to the bottom wall in the region designated at 18.

In the particular embodiment shown, the bottom wall 14 and the side wall 16 are formed from relatively rigid paperboard. The bottom wall 14 is circular and is positioned substantially horizontally when the construction 10 is oriented as shown in FIG. 1. Also, the side wall construction 16 is circular in cross-section and is inclined outwardly as it extends upwardly (i.e. it is inverted frusto-conical). The bottom wall 14 can be secured to the side wall 16 in region 18 by conventional folding and crimping as shown at 19.

The principles of the present invention can be applied to arrangements with a wide variety of geometric shapes. The circular bucket or tub shape shown is particularly convenient and attractive, and such "tubs" are readily available commercially.

A particularly convenient and preferred consumer product is one having about 2.8 oz. of popcorn/oil/flavoring in the container 12 and can be made using a conventional substantially microwave transparent, half gallon ice cream tub, with the bottom wall 14 comprising uncoated bleached kraft paper and with the sidewall 16 made from bleached kraft paperboard clay coated on the outside and polyethylene coated on the inside. Such tubs are available commercially from Sherri Corp. Inc. of Kensington, Conn. 06037.

The side wall construction 16 includes an upper edge 17 which is curled outwardly to provide a rim 20. The rim 20 defines an open mouth 22 in the construction 10.

Figure 2:
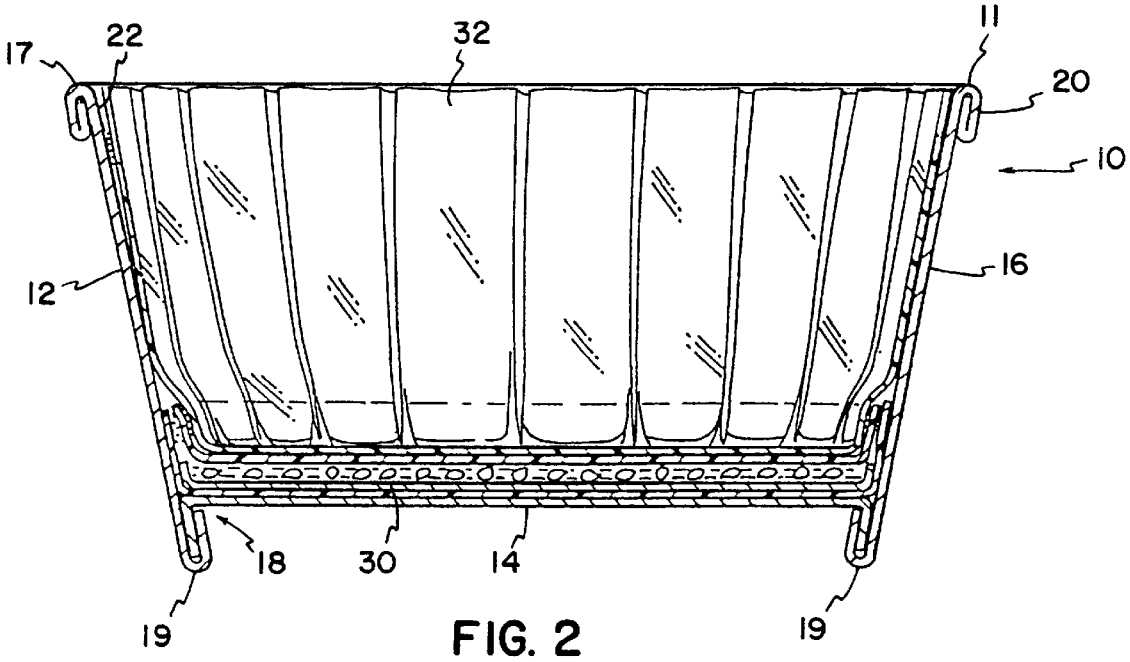
FIG. 2 is a vertical cross-sectional view of the construction shown in FIG. 1.

Referring to FIG. 2, in the preferred embodiment shown, the side wall construction 16 tapers outwardly, in extension toward the open mouth 22, an amount sufficient to permit individual containers 12 to be conveniently nested inside one another during storage, shipment, on store shelves or in consumer's cupboards. Together, the side wall construction 16 and bottom wall 14 define a convenient container 12 for serving and eating popcorn.

The portion of the package 10 thus far described is a self supporting, rigid enclosure. The enclosure, in use, contains certain components (shown in FIG. 4) which are placed in the container body 12 during assembly. These include subassembly 30 and cover or balloon film 32. A possible assembly procedure is described in the association with the schematics of FIGS. 10–12. In uses, the entire package 10, including container body 12 and enclosed items described, is placed in a microwave oven.

In the arrangement depicted, FIGS. 4 and 5, subassembly 30 comprises three principal elements, as follows: a dish 33; a charge 34 of popcorn (optionally including oil, flavoring and/or color); and, a moisture barrier closure 35 including a first (top) portion 37 and a second (bottom) portion 36. The top portion 37 of the moisture barrier enclosure 35 is bonded to the bottom portion 36 by a heat releasable perimeter seal 40 (FIG. 5) to define an enclosed volume 41. The dish 33 and charge 34 are enclosed within volume 41.

Figure 5:
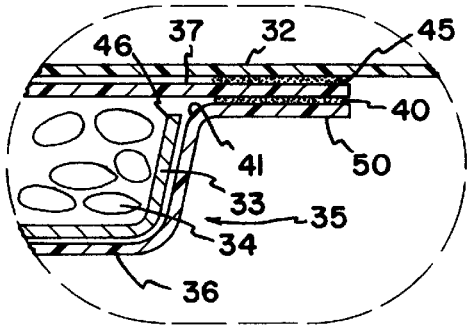
FIG. 5 is an enlarged, fragmentary, partial vertical sectional view of FIG. 4, showing detail of a seal at an edge of the moisture barrier enclosure.
Figure 7:
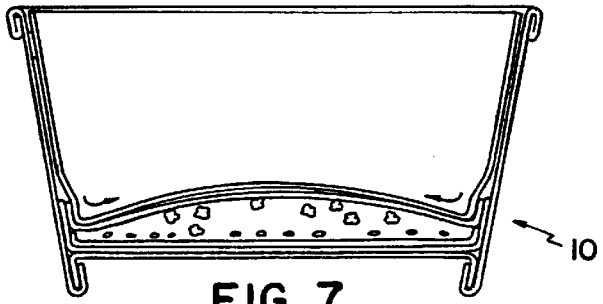
FIGS. 6–9 are successive sequential diagrammatic vertical sectional views showing a possible progressive expansion of the construction of FIG. 1 as corn therein is popped.
Figure 6:
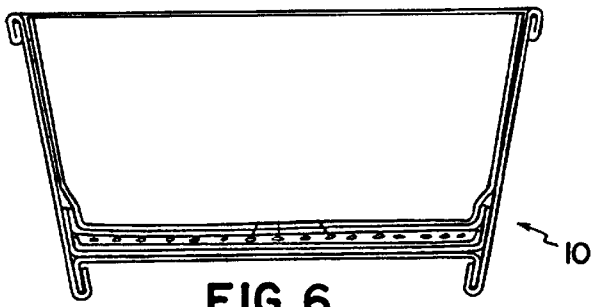
Figure 9:
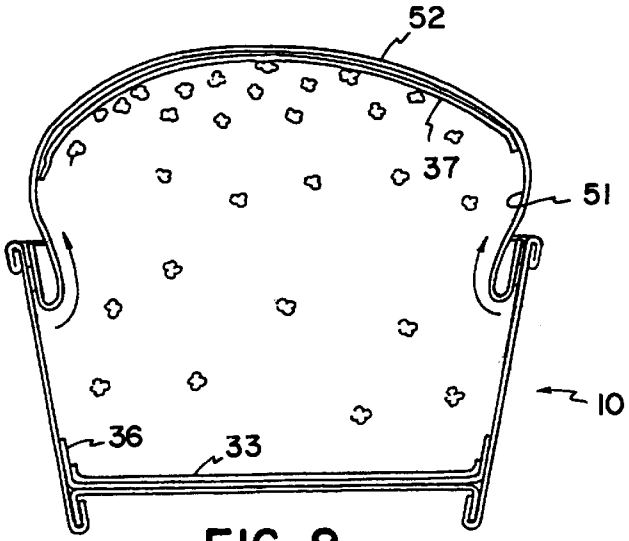
Figure 8:
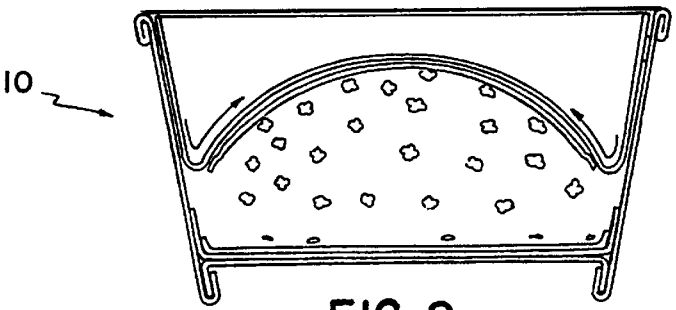

The balloon film 32 is bonded to the outer (upper) surface of the top portion 37 by seal 45, FIG. 5.

Preferred materials for the moisture barrier are described hereinbelow. They are selected to provide for both good moisture loss protection for the enclosed popcorn charge 34; and, for good performance under the conditions encountered during heating.

In general, the dish 33 is a material which is sized and shaped to contain the popcorn charge 34, during heating. Preferably it contains a microwave interactive material or microwave susceptor, which becomes heated when exposed to microwave energy. When dish 33 comprises or contains a microwave interactive material, it will generally enhance the performance of the product during cooking. Conventional microwave susceptor materials may be used for the microwave interactive material, in dish 33.

The dish 33 preferably has an outer peripheral rim 46, FIG. 5. An outer diameter of the rim 46 of the dish 33 is preferably sized so as to enable the dish 33 to fit snugly within the moisture barrier closure 35, FIG. 2, so that corn and oil will readily drain back into the dish 33 as they splash about during popping.

In some arrangements, the dish 33 may comprise, throughout its entire construction, a layer of microwave interactive material. In such arrangements, a preferred material for the dish 33 is a trilaminate consisting of a bleached greaseproof paper bonded to one side of a metallized polyester film; with a layer of bleached kraft paper bonded to the other side of the polyester film. The cross-sectional drawings do not show the different layers in dish 33, since such detail is not necessary to understand the invention. It will be understood that preferably dish 33 is a laminate, as described.

The metallized polyester film is preferably a microwave interactive material such as described in U.S. Pat. Nos. 4,878,765; 4,641,005; 4,267,420; 4,230,924; and 4,735,513, each of which is incorporated herein by reference. Such arrangements have generally been utilized flexible bag constructions, as microwave interactive materials. For them, the metallized polyester typically comprises a polyester film with a vacuum deposited metallic coating on one side thereof, the metallic coating typically being aluminum. Generally in flexible bag constructions, the polyester film comprises a material such as Hoechst Celanese 2600 48 gauge polyester film. However, 92 gauge film, rather than the commonly used 48 gauge, will sometimes be preferred for arrangements according to the present invention because of the stresses involved in the operations for forming dish 33. It is foreseen, however, that the lighter gauges should be suitable in some applications. Suitable metallized polyester is available from MADICO of Woburn, Wash. 01888.

The preferred weight of the greaseproof paper in the dish 33 is 22–25 lb/ream, with 22 lb/ream most preferred; and, the preferred weight of the bleached kraft paper in the dish 33 is 90–140 lb/ream, with 110 lb/ream most preferred. Preferably, the greaseproof paper is oriented on the side of dish 33 forming the interior, with the bleached kraft paper being on the opposite (outer) side. Preferably the "metal side" of the metallized polyester is directed away from the inside of the dish 33. Lamination adhesives and adhesive weights commonly used for the assembly of microwave popcorn bags are suitable for securing the various layers of dish 33 together. For example, a polyvinylacetate copolymer emulsion adhesive, product number WC-3460ZZ from H.B. Fuller Co. of Vadnais Heights, Minn. can be used.

In general, the balloon film 32 operates as a cover for enclosed materials during storage, to retain heat and steam during popping, and to allow for expansion of the enclosed volume within container 12 during the microwave popping process. As will be seen from descriptions below, balloon film 32 operates to achieve this, by inverting during use, as heat and steam are built up inside the enclosed space underneath the balloon film and within container 12. For operation in this manner, the balloon film 32 is preferably a strong, thin, lightweight material.

A preferred material for the balloon film 32 is Mylar 50 RL3, a polyester film with a heat sealable wax like coating. Mylar 50 RL3 is available from DuPont of Wilmington, Del.

The subassembly 30 and balloon film 32 are secured within tub 12 to produce construction 10. An operation to effect this is described in connection with FIGS. 10–12, and concerns plunging an assembly comprising cover 32 and subassembly 30 into tub 12 with a heated mandrel appropriately shaped to closely match an interior shape of tub 12. The heated mandrel generates sealing between balloon film 32 and top portion 37 generally wherever they touch. The heated mandrel also makes a releasable perimeter seal 48 (FIG. 3) between the balloon film 32 and sidewall 16 and, further, through a thermoforming type operation causes the balloon film 32 to closely conform to the interior shape of tub 12, which enhances nesting of finished packages.

Figure 12:
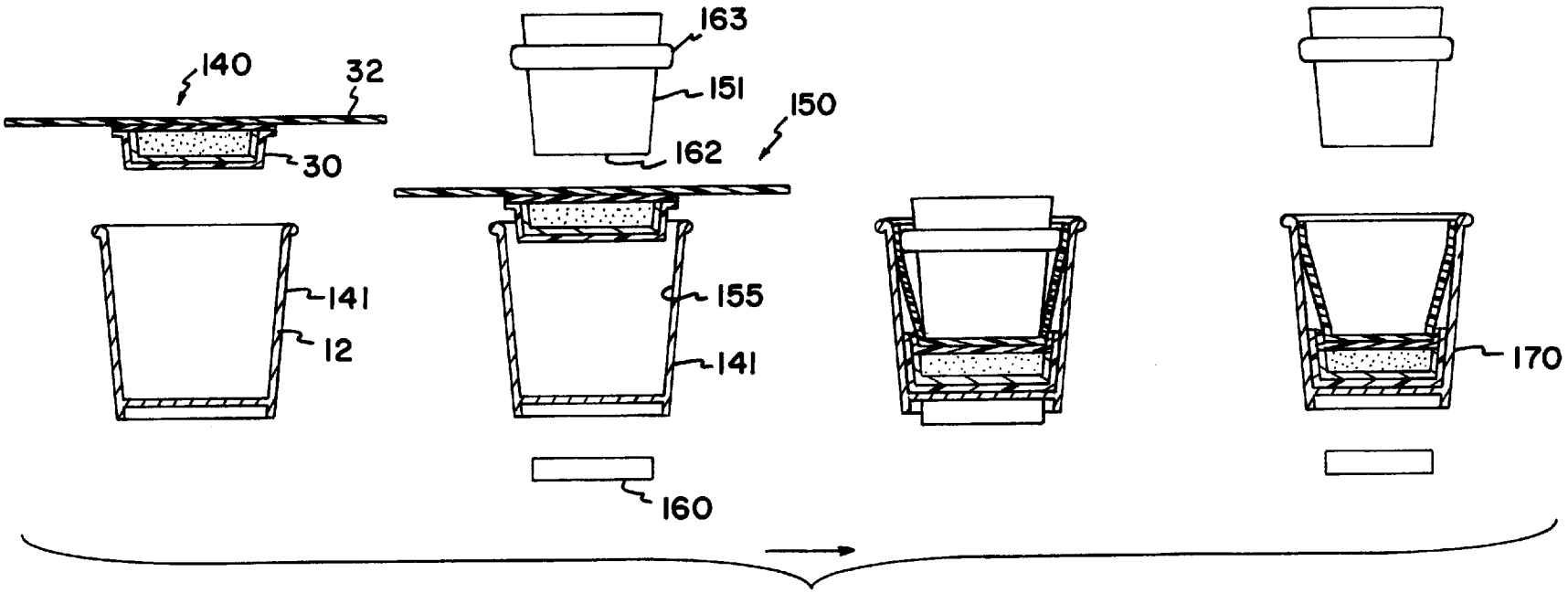
FIG. 12 is a schematic depiction of successive steps in a stage of assembly following the stage of FIG. 11.

In preferred applications, the subassembly 30 is secured to the bottom 14 of tub 12. This is preferably achieved by friction between the sidewall of subassembly 30 against sidewall 16, optionally enhanced by heat sealing the outer surface of bottom portion 36 to tub bottom 14 by means of a heat sealable outer surface of bottom portion 36 or the addition of small strips of a suitable hot melt adhesive, such as Fuller HMZ052, available from H.B. Fuller Co., St. Paul, Minn. Heat to generate this sealing can be applied by using a bottom heater as shown in FIG. 12 to heat seal the bottom portion 36 to the bottom 14 of the tub 10.

Figure 3:
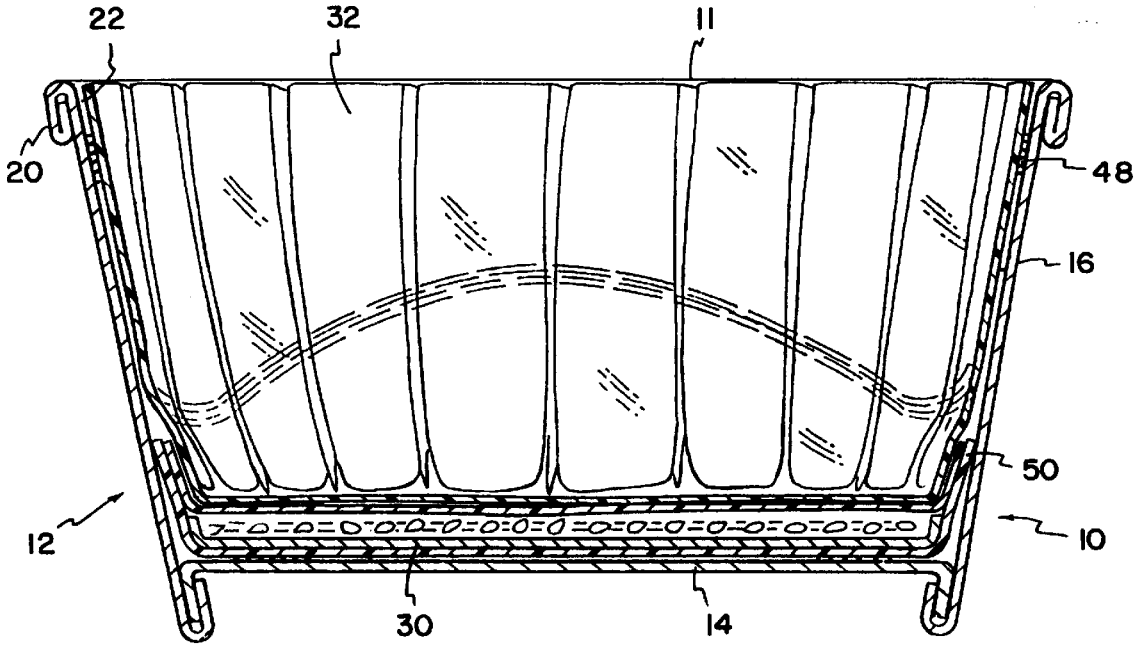
FIG. 3 is a diagrammatic view analogous to FIG. 2, showing location of various bonds used in the construction.
Figure 4:
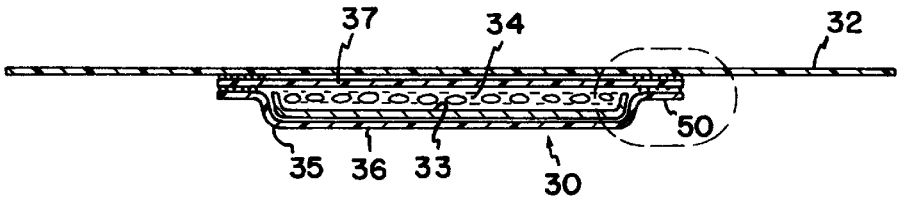
FIG. 4 is an enlarged cross-sectional view of a subassembly for use in the construction of FIG. 1, showing a moisture barrier enclosure.

Referring to FIGS. 4 and 5, in preferred embodiments, prior to being inserted in container 12, enclosure 35 includes outer rim 50. Specifically, outer rim 50 comprises a portion of bottom portion 36, to which top portion 37 is secured by seal 40, FIG. 5. Preferably outer rim 50 is of an appropriate diameter so that when enclosure 34 is inserted within container 12, FIG. 3, rim 50 is bent or folded up somewhat as shown in FIGS. 2 and 3. This will help ensure a secure fit, due to the snug engagement between rim 50 and side wall 16.

Operation of the Invention

In use, the fully assembled package 10 is placed in a microwave oven, a suitable time is set and the oven is operated. As shown in FIGS. 6–9, upon exposure to microwave energy, the popcorn/oil charge 34 heats, causing the oil (if present) to melt and the corn to pop. The process results in generation of considerable amounts of steam and heat. This action is enhanced by heat generated by the susceptor material located within the dish 33.

The hot air and steam build up until sufficient heat and pressure is available to break or release the releasable perimeter seal 40 between the top and bottom portions of the moisture barrier enclosure 34. The hot air and steam then proceeds to invert or puff out the balloon film 32, which carries away the moisture barrier top portion 37, forming a chamber 51, FIG. 9, for holding the popping corn. The balloon releasable rim seal 48 serves to keep the puffed out balloon 52, FIG. 9, in place over the popping corn. After completion of popping, the package is removed from the oven and is allowed to cool for about 30 seconds. The remnants of the balloon film can be easily manually removed. The result is a volume of freshly popped corn in a ready-to-serve, convenient and attractive container.

Preferred Methods of Construction

Figure 10:
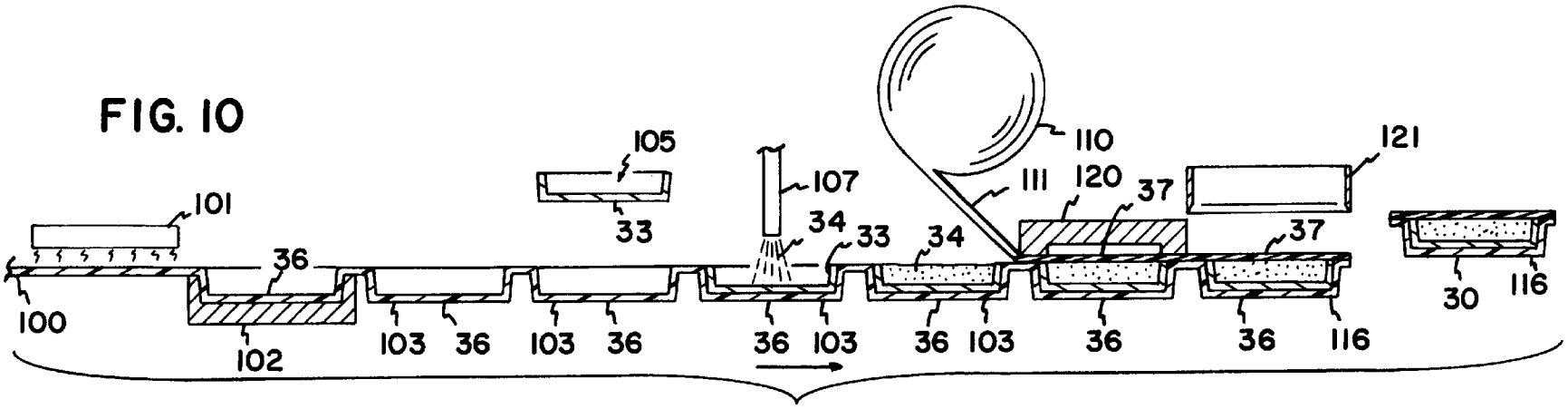
FIG. 10 is a schematic depiction of successive steps in a stage of assembly of a construction such as that shown in FIG. 1.
Figure 11:
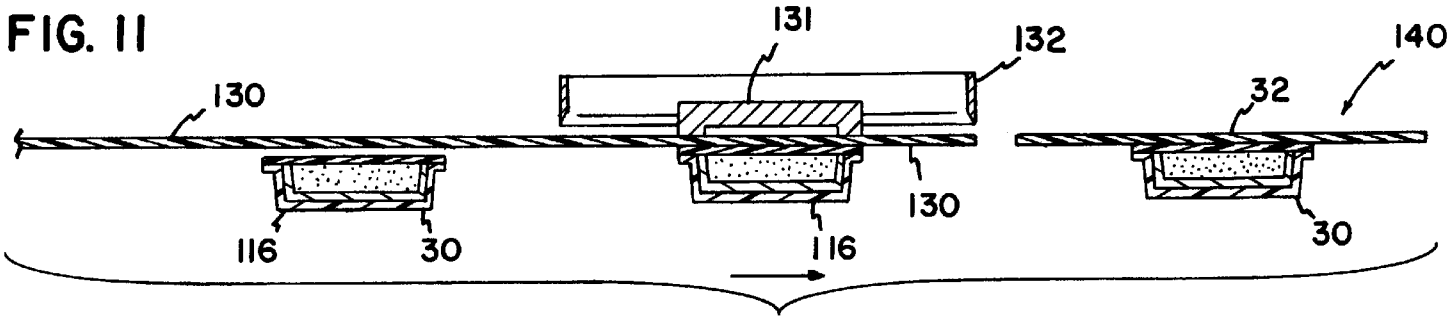
FIG. 11 is a schematic depiction of successive steps in a stage of assembly following the stage of FIG. 10.

In FIGS. 10–12, a diagrammatic depiction of a process for use in preparing an arrangement according to the present invention is provided. It will be understood that variation of the process may be utilized, and indeed in some instances "step-by-step" operation can be used. The diagrammatic representation shown, however, illustrates that certain preferred embodiments process according to the present invention are designed for ease of mass assembly line manufacture, if desired.

In FIG. 10, steps are shown for creation of subassembly 30. In FIG. 11, the balloon film is secured to the subassembly 30. In FIG. 12, the assembly comprising the balloon film 32 and the subassembly 30 is inserted into a premade tub 12.

Referring to FIG. 10, a feed sheet of material, from which bottom portion 36 of moisture barrier 35 (FIG. 4) is formed, is shown being fed into the process at reference numeral 100. The material of sheet 100 is preferably thermoformable, and comprises a preferred material described hereinbelow. At 101, a heater is shown heating sheet 100 sufficiently for a thermoformable operation. At 102, a thermoform operation is shown, generating a series of attached depressions 103 in sheet 100.

At 105, dish 33 is shown being positioned in depression 103. Dish 33, it will be understood, will have been preformed out of an appropriate microwave interactive material or at least to include an appropriate microwave interactive material, in preferred embodiments.

At 107, a charge 34 of popcorn, oil and flavoring is shown being dispensed in dish 33. These may be separately added, if desired.

Moving further along the stage of assembly shown in FIG. 10, at 110, a roll of continuous feed stock 111 for formation of top portion 37 is depicted. Referring to FIG. 10, this is shown with film 111 extended as top portion 37 continuously over bottom portion 36. At 120, a heat sealing apparatus is shown for forming perimeter edge seal 40. At 121, a cutter is shown cutting subassembly 116 from the continuous stream. Subassembly 116 is now ready to be transferred to the next stage of assembly, shown in FIG. 11.

Referring to FIG. 11, subassembly 116 is shown being positioned for attachment of a balloon film thereto. In FIG. 11, continuous feed of balloon film material is indicated at 130. At 131, heat sealing apparatus is shown sealing balloon film material 130 to subassembly 116 by forming perimeter seal 45, FIG. 5. At 132 an apparatus for cutting the balloon film material is shown. At 140, an assembly comprising balloon film 32 and enclosure 30 is shown, ready to be transferred onto the stage of operation shown in FIG. 12.

Referring to FIG. 12, assembly 140 is depicted. Tub 141 is also shown. Equipment will be used to align the items appropriately for insertion of unit 140 into tub 141, as indicated at site 150. For the operation, mandrel or plunger 151 is shown, which can push arrangement 140 into interior 155 of tub 141. A plate 160 is shown selectively moveable to be oriented adjacent of bottom portion of tub 141, to apply heat for adhering a bottom of assembly 140 to the bottom of the tub 141. Mandrel 151 is preferably heated along surface 162, to further seal the balloon film 32 to the remainder of item 140; and, the mandrel includes heat ring 163 oriented for generating seal 48, FIG. 3, in the finished package.

At 170, the finished package is shown leaving the assembly line.

Preferred Moisture Barrier Materials

As described above, the preferred moisture barrier enclosure 35 comprises: a first (top) portion 37; and, a second (bottom) portion 36 bonded together with a releasable perimeter seal 40. In some applications these two portions (36, 37) will be exposed to different manufacturing conditions and different environmental conditions during microwave popping. In certain preferred applications, different materials are used for these first and second portions 37, 36 of the moisture barrier enclosure 35.

Preferably, both first and second portions 37, 36 in moisture barrier enclosure 35 comprise a moisture barrier effective film, preferably a polyolefin film, applied to or adhered to relatively heat resistant film, preferably a polyester film. By "heat resistant" in this context it is meant that the film corresponding to the polyester film is sufficiently strong and heat resistant to withstand the conditions of use to an appropriate amount. That is, it is sufficiently dimensionally stable under conditions of ordinary use. From the following specific examples, this will be further understood.

The preferred material for the first (top) portion is a lamination of an oriented polypropylene film bonded to one side of a polyester film (for example, polyethylene terephthalate) having a wax coating, for releasable heat sealing, on the side away from the film of oriented polypropylene. More specifically, the preferred material is a lamination of 100 to 160 gauge oriented polypropylene bonded to Mylar 50 RL3 with 5 to 7 lb/3000 sq. ft. of polyethylene. (Mylar 50 RL3 is a wax coated polyester film. Mylar 50 RL3 is available from E I DuPont, Wilmington, Del.). The terms "bonded to" and "laminated to" in this context are not meant to indicate whether or not an adhesive is used between the layers.

Popcorn as it pops releases steam at temperatures on the order of 350° F. Thus any material overlying popcorn will be exposed to considerable heat during popping.

Polyester film has excellent resistance to heat but relatively poor moisture barrier properties. Oriented polypropylene has excellent moisture barrier properties but relatively low resistance to heat. It has been discovered that combining the two results in a film with good heat resistance and good moisture barrier properties. It has also been discovered that a good grade, acceptable wax coating such as that provided on Mylar 50 RL3 provides a suitable releasable perimeter bond 40 when heat sealed to the perimeter of the bottom portion 36. Preferably the top portion 37 is oriented in the enclosure 35 with the side having the moisture barrier polyolefin film oriented away from the inside 41 of the enclosure 35, FIG. 5.

The preferred material for the bottom portion 36 of the moisture barrier enclosure 35 is also a lamination comprising a moisture barrier polyolefin film (such as polyethylene or polypropylene) bonded to a polyester film. However, in certain applications, a different form of laminate is preferred for bottom portion 36, than top portion 37.

In the preferred arrangement described, the bottom portion 36 is thermoformed into a cup or dish shape that closely conforms to the dish 33 holding the popcorn/oil charge 34, and with flattened outer rim 50, FIG. 5. The rim 50 provides a surface to which the top portion 37 can be readily releaseably bonded, for example at seal 40, FIG. 5, by the wax material. Thus the preferred material for the bottom portion 36 is preferably a material suitable for thermoforming. Also, for some preferred arrangements the bottom portion 36 will be in direct contact with a dish 33 containing a microwave susceptor. In use, microwave susceptors can reach operating temperatures on the order of 400° F. Thus, the lower portion 36 in such arrangements may need even more temperature resistance than the top portion 37, to function well.

In certain embodiments, the preferred material for the bottom portion 36 is a lamination comprising a moisture barrier polyolefin laminated to a thermoformable substrate, typically a polyester. A useful material comprises 75 gauge Mylar P25 thermoformable polyester film (polyethylene terephthalate) adhesively bonded to a 4 mil cast polypropylene film. For the cast polypropylene film, a commercially available film such as InteCast - 75 C3 400, available from Amtopp Corporation, Livingston N.J., may be used. Preferably, the cast polypropylene will be a material which has its outside surface formulated for heat sealing. The thermoformable polyester film is available from DuPont.

In general, oriented films are much preferred in food packaging applications because of substantial improvements in physical properties, especially moisture barrier, resulting from the orientation process.

Cast films differ from oriented films in that oriented films generally have much greater heat shrinkage than cast films. In the case of the top portion 37, what is desired is some heat shrinkage so as to assist the release of the releasable perimeter bond 40 during heating. In the case of the bottom portion 36, what is desired is to limit heat shrinkage sufficiently to avoid disrupting the position of the dish 33. Thus, an oriented film is preferred for the top portion 37 and a cast film is preferred for the bottom portion 36. In preferred applications, the polyester surfaces of each of portions 36 and 37, which have superior heat resistance, face toward the enclosed popcorn charge 34.

What is claimed is:

1. A construction for heating popcorn in a microwave oven; said construction comprising:

(a) an outer rigid-walled tub-shaped receptacle having an open top;

(b) a flexible, invertible, cover enclosing said tub-shaped receptacle;

(c) a moisture barrier closure positioned within the outer receptacle and underneath said cover; said moisture barrier closure comprising a top portion, a bottom portion and an inside;

(i) said top portion comprising a sheet of polyester material having a moisture barrier film of oriented polyolefin material laminated thereto, said polyolefin material laminated away from the inside of said closure relative to said polyester material;

(ii) said bottom portion comprising a moisture barrier film of cast polypropylene on a thermoformable polyester substrate; said bottom portion being thermoformed into a dish-shaped receptacle;

(iii) said top portion of said moisture barrier closure being heat sealed to said bottom portion of said moisture barrier closure, by a perimeter seal;

(d) a dish, comprising a microwave interactive construction, enclosed within said moisture barrier closure and positioned on said bottom portion; and, (e) a charge of unpopped popcorn positioned within said dish and inside said moisture barrier closure;

(f) said invertible cover being secured to said top portion of said moisture barrier closure.

2. A construction according to claim 1 including:

(a) oil or fat mixed with said charge of popcorn.

3. A construction according to claim 1 wherein:

(a) said outer, tub-shaped, receptacle has a bottom wall; and, (b) said moisture barrier closure bottom portion is adhesively secured to said outer receptacle bottom wall.

4. A construction according to claim 3 wherein:

(a) said perimeter seal between said top portion and said bottom portion is a heat-releasable perimeter seal.

5. A construction according to claim 1 wherein:

(a) said perimeter seal between said top portion and said bottom portion is a heat-releasable perimeter seal.

6. A construction according to claim 1 wherein:

(a) said outer rigid-walled tub-shaped receptacle is a paperboard receptacle.

7. A construction according to claim 1 wherein:

(a) said invertible cover is secured to said top portion of the moisture barrier closure by a seal.

* * * * *